United States Patent [19]

Woodward

[11] Patent Number: 5,072,978

[45] Date of Patent: Dec. 17, 1991

[54] INSIDE LOCK FOR LATCHES OF CAMPER SHELLS, AND SIMILAR STRUCTURES

[76] Inventor: Jonathan Woodward, 625 N. Stone Ave., Tucson, Ariz. 85705

[21] Appl. No.: 575,359

[22] Filed: Aug. 30, 1990

[51] Int. Cl.[5] ..... E05B 13/00

[52] U.S. Cl. ..... 292/359; 70/416

[58] Field of Search ..... 292/359, 358, 352, 353; 70/416

[56] References Cited

U.S. PATENT DOCUMENTS

| | | | |
|---|---|---|---|
| 350,609 | 10/1886 | Whittlesey | 292/359 |
| 588,673 | 8/1897 | Wyman | 292/359 |
| 861,421 | 7/1907 | Young | 292/359 |
| 2,574,726 | 11/1951 | Best | 292/359 |

FOREIGN PATENT DOCUMENTS

| | | | |
|---|---|---|---|
| 140107 | 3/1920 | United Kingdom | 292/359 |

*Primary Examiner*—Robert L. Wolfe

[57] ABSTRACT

An inside lock for the latch of a camper shell or other similar structure has a housing which is fixed on the inside of a door with a bore surrounding an actuating rod extending from a lockable handle on the outside and rotatable therewith. The actuating rod, for example of square section, normally carries an actuating member which releases latch members at the periphery of the door on rotation of the handle. A removable member, for example a pin bent into a U-shape, is inserted in a transverse hole or holes in the housing, with a part of the pin abutting a surface or surfaces on the rod, preventing rotation thereof. This provides for locking the handle from rotation on the inside, even though the handle lock is released.

19 Claims, 4 Drawing Sheets

INSIDE LOCK FOR LATCHES OF CAMPER SHELLS, AND SIMILAR STRUCTURES

BACKGROUND OF THE INVENTION

1. Field of the Invention

This invention relates to an inside lock for camper shells, and similar structures, and in particular is concerned with means for locking the latch of the camper shell from the inside.

2. Related Art

Camper shells, and similar structures, have an entrance door for access to the interior of the shell. The door is held closed by a latch which itself can be locked from the outside. Normally the latch is self-locking, with a key to release a locking mechanism to permit the latch to be rotated. Rotation of the latch releases the locking members on the door and which engage with locking positions on a surrounding frame.

Typical examples of such latches are those used for garage doors in addition to shell doors. These are actuated by a handle on the outside, which, when released by use of a key, can be rotated to actuate locking members to release the door. In use, to obtain entry, a key is inserted and rotated to unlock the latch. The key is then removed. The latch handle is rotated to release the locking members and the door opened. A spring bias is normally provided to return the handle, and locking members, to the locking or latching, position. A handle can be provided on the inside to actuate the latch from the inside, as long as the latch is unlocked.

However, once occupants of a camper shell are in the shell, while they can readily actuate the latch from the inside to open the door, they cannot lock the latch, for privacy and/or security reasons. The same applies to garage doors and other similar structures.

SUMMARY OF THE INVENTION

The present invention provides a locking device which is applied to lock a latch from the inside. Broadly the invention provides a removable member which engages with a rotatable part of a latch, preventing rotation thereof, and thereby preventing actuation of the latch.

Conventional latches have a shaft of polygonal section, typically square, extending from the latch inside. The present invention provides a housing or lock member for positioning over the shaft and adapted to be attached to the inside of the door. A pin extends the housing, positioned such that when the pin is in position, it is in contact with at least one of the surfaces of the shaft, preventing rotation. On removal of the pin, the shaft can rotate in the housing. Conveniently the pin is of a somewhat U form, with in one embodiment, one leg passing through the housing and the other leg shaped to resiliently engage with the housing, to retain the pin in place. In an alternative embodiment, both legs of a U-shaped pin pass through the housing engaging with opposite surfaces of the shaft. In a modified form, the shaft may be of cylindrical section with at least one surface for engagement by or contact with the pin.

BRIEF DESCRIPTION OF THE DRAWINGS

The invention will be readily understood by the following description of certain embodiments, by way of example, in conjunction with the accompanying drawings, in which:

As illustrated in FIG. 1, a latch, generally indicated at 10, has a handle 11 rotatably mounted on a housing 12, the housing having holes 13 for attachment to a door, indicated in chain dotted outline at 14. The handle 11 has a cylindrical barrel portion 15 which cooperates with a cylindrical barrel portion 16 of the housing 12. Within the barrel portions is a lock, the end of which is seen at 17. A key slot 18 permits insertion of a key which enables rotation of the lock within the barrel portion 15 and in turn permits rotation of the handle 11 relative to the housing 12. A shaft 19 extends from the rear of the latch.

FIG. 2 illustrates the near side of a latch, on the inside of the door 14. In the example, the shaft 19 is square and positioned on the shaft is an actuating member 20. Member 20 has a square aperture 21 which is a fairly close fit on the shaft. Extending from the actuating member 20 are two levers 22. Cables, or other members 23 extend from the ends of the levers 22 to locking members positioned at the edges of the door. When the latch 10 is unlocked, rotation of the handle 11 rotates shaft 19 and the actuating member 20, together with the levers 22. This movement, for example clockwise in FIG. 2, pulls the cables 23 and releases the locking members. Normally a spring bias acts to maintain the locking members engaged. However, with the catch 10 unlocked, the handle can be turned at any time, and by providing a handle on the shaft on the inside, the shaft can also be rotated from the inside of the door. However, it is not possible to lock the latch from the inside.

FIG. 3 illustrates the latch 10 in position in a door as used for a camper shell or similar structure. The door has outer and inner walls 25 and 26 respectively. The housing 12 of the latch is attached to the outer wall 25 and the actuating member 20, with levers 22 and cables 23, is inserted between the walls. The shaft 19 extends through the inside wall.

FIGS. 4 and 5 illustrate one form of a housing or lock member 30 for attachment to the inside wall 26. It comprises a base member 31 with holes 32 for attachment to the wall, and a tubular housing or extension 33 having a central bore 34 which is a clearance on the shaft 19. Extending through the wall of the extension 33 is a transverse hole 35. The hole 35 is positioned such that a pin can be inserted with the pin extending into the bore 34.

FIG. 6 illustrates one form of pin 36 which is used with the housing or lock member 30. The pin has two legs 37, 38, which extend generally parallel and joined at one end by an arcuate portion 39, forming a somewhat U-shape. One leg, 37, is straight and the other leg, 38, has an arcuate bend 40 along its length, the bend extending away from the leg 37. The free end of leg 38 is bent outward slightly, at 41, to east insertion of the pin.

FIG. 7 shows the pin 36 inserted in the housing 30, with the straight leg 38 bearing against a surface of the shaft 19. It will be seen that, with the pin inserted, the shaft 19 cannot be rotated. The arcuate portion 39 assists in inserting and removing the pin and also provides some resistance, permitting leg 38 to move away from leg 37 as the free end of leg 38 passes the extension 33, snapping back when the arcuate bend 40 engages with the extension.

FIGS. 8 and 9 illustrate an alternative form of housing or lock member 30. It comprises the base member 31 with holes 32 for attachment to the wall, tubular housing or extension 33, with central bore 34. In this embodiment, there are two holes 35 extending transversely through the wall of the extension 33. The holes 35 are spaced such that a pin inserted in the holes will extend into the bore 34 at either side.

FIG. 10 illustrates a form of the pin 36 which can be used with the housing or lock member 30 of FIGS. 8 and 9. The pin is generally U-shaped, with two legs 37 and 38, in this example extending substantially parallel. The legs are joined by arcuate portion 39. Preferably the spacing of the legs 37 and 38 is generally of the same dimensions as the shaft 19, across opposed surfaces.

FIG. 11 shows the pin 36 of FIG. 10 inserted in the housing 30 of FIGS. 8 and 9. The two legs of 37 and 38 pass through the holes 35 in the housing 30 and engage with opposed surfaces on the shaft 19. It will be seen that with the pin inserted, the shaft cannot be rotated. If desired the legs 37 and 38 can have an initial formation in which they are inclined outwards, as indicated in dotted outline in FIG. 10. The legs would then be urged towards each other for entry into the holes 35 and provide some frictional resistance to unwanted removal. In such an arrangement the arcuate portion 39 would have some resistance of "springy" capacity.

FIG. 12 illustrates the lock of either embodiment, applied to a latch, on a door. FIG. 12, which is similar to FIG. 3, apart from the lock, shows the handle 11, housing 12, actuating member 20 with levers 22, and the shaft 19, of the latch 10. On the inner wall 26 is attached the housing 30 and pin 36 is also shown in position, Thus, although the latch 10 may be unlocked, and free to rotate relative to the housing 10, the pin 36 prevents rotation of the shaft 19 and this prevents rotation of the handle 11, with corresponding prevention of rotation of the actuating member 20.

Figure 1:
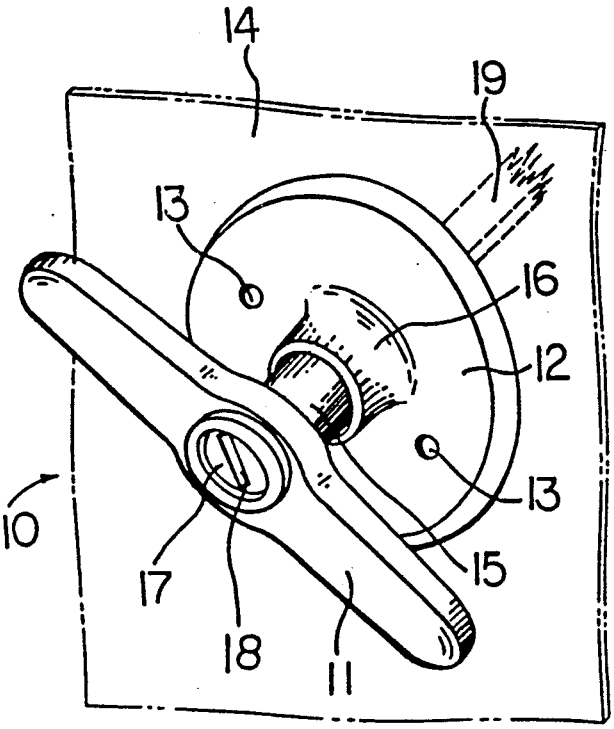
FIG. 1 is a perspective view of a conventional latch.
Figure 2:
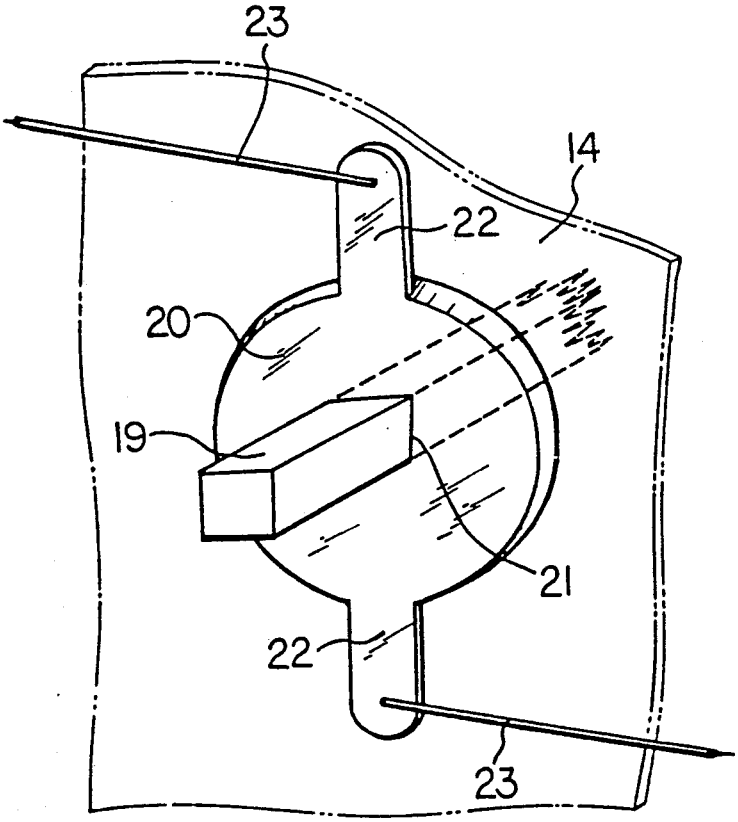
FIG. 2 is a perspective view of part of the rear of the latch of FIG. 1.
Figure 3:
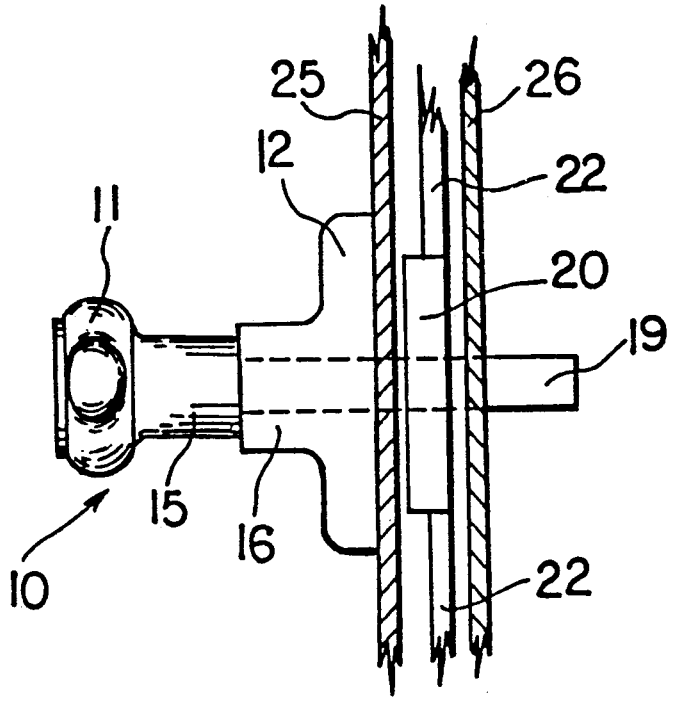
FIG. 3 is a cross-section through a door, showing the latch in position.
Figure 4:
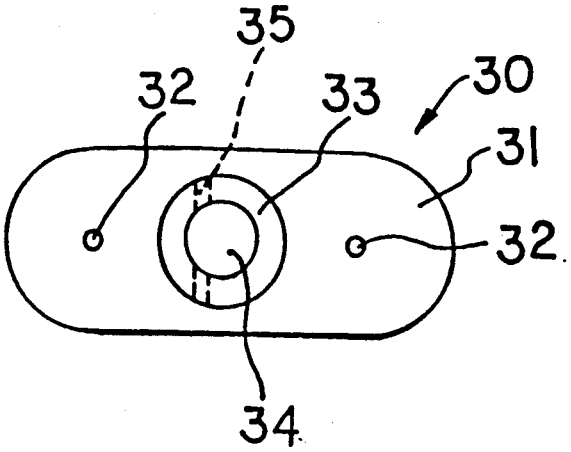
FIGS. 4 and 5 are top view and side view respectively of a housing for a lock in accordance with one embodiment of the invention.
Figure 5:
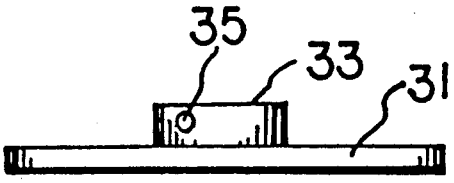
Figure 6:
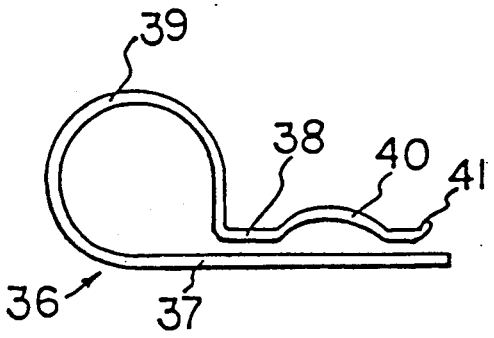
FIG. 6 is a side view of one form of locking pin for use with the housing of FIGS. 4 and 5.
Figure 7:
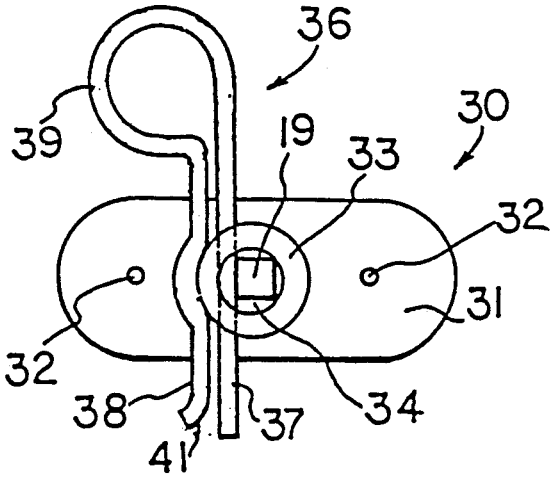
FIG. 7 is a plan view of the embodiment illustrated in FIGS. 4, 5 and 6 in position on a shaft of a latch.
Figure 8:
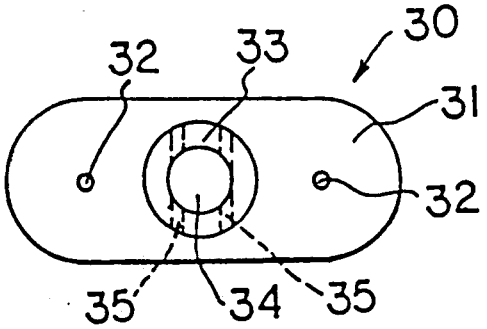
FIGS. 8 and 9 are top view and side view respectively of an alternative housing for a lock in accordance with the invention.
Figure 9:
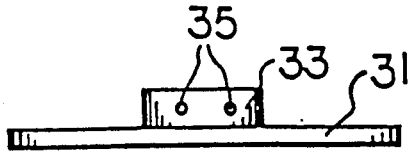
Figure 10:
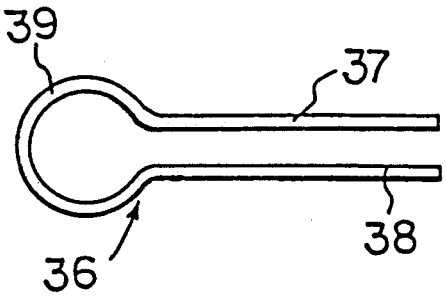
FIG. 10 is a side view of an alternative form of locking pin for use with the housing of FIGS. 8 and 9.
Figure 11:
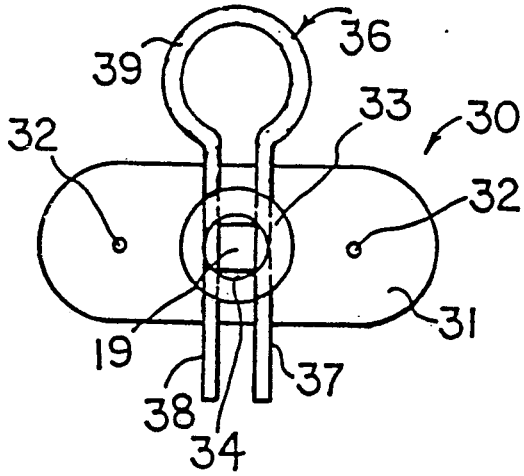
FIG. 11 is a plan view of a lock of the alternative form of the present invention on a shaft of a latch.
Figure 12:
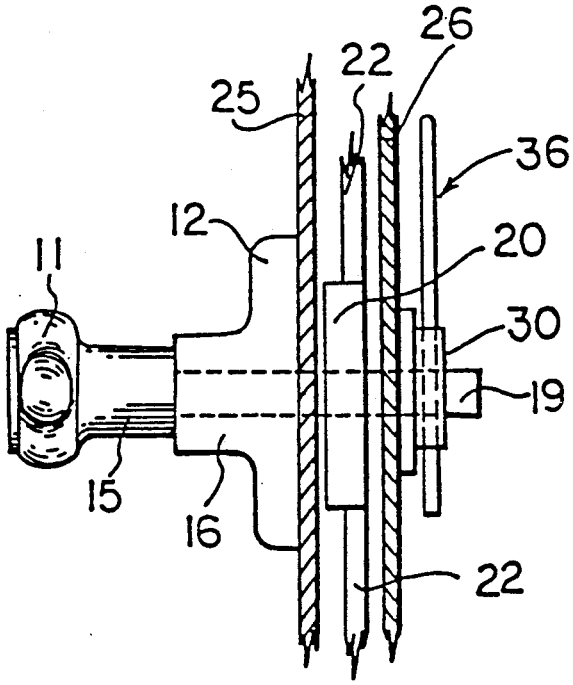
FIG. 12 is a cross-section similar to that of FIG. 3, illustrating the application of a lock to a latch.

When occupants of a camper shell wish to be in the shell, they can unlock the latch from the outside, open the door, enter the shell and close the door, and then lock the latch from the inside by inserting the pin. A pin or some similar device can be used for a square shaft, or with shafts having other cross sections. If a cylindrical shaft is used, then one or more flat surfaces or other formation will need to be formed on the shaft for engagement by the pin. In such an arrangement the actuating member 20 will be connected to the shaft by some other means, for example a tubular member on the actuating member with screws fixedly connecting to the shaft.

What is claimed is:

1. An inside lock for a latch of a camper shell and similar structures, comprising, a latch for attachment to the outside of a door, said latch comprising a housing for fixed attachment to the outside of the door, and including a housing, a handle rotatably mounted in said housing and including locking means rotatable at said handle for locking rotation of said handle outside said structure; a rotatable member extending from said housing and rotatable with said handle through said door; actuating means mounted on said rotatable member for rotation therewith and latch means operatively connected to said actuating means; a lock member comprising a further housing for fixed attachment to the inside of the door and including a bore surrounding said rotatable member, said rotatable member freely rotatably in said bore; at least one transverse hole through said further housing, penetrating into said bore; a removable member for insertion into said hole, and including a part for abutment against a flat surface on said rotatable member, to prevent rotation thereof.

2. A lock an claimed in claim 1, said removable member comprising a U-shaped member having two substantially parallel legs, one of said legs adapted for insertion into said hole.

3. A lock as claimed in claim 2, said legs spaced closely together and joined at one end by an arcuate member.

4. A lock as claimed in claim 3, the other of said legs having a bent formation intermediate its ends, the bend extending away from said one leg, said bent formation in contact with an outside surface of the housing of the lock member when said one leg is in said hole.

5. A lock as claimed in claim 4, said bent formation having a shape conforming to the outside surface of the housing of the lock member, to resiliently retain said removable member in said lock member.

6. A lock as claimed in claim 5, said outside surface being cylindrical and said bent formation being arcute.

7. A lock as claimed in claim 1, including two spaced parallel transverse holes through said further housing, said removable member comprising a U-shaped member having two substantially parallel legs, adapted for insertion in said two spaced parallel transverse holes.

8. A lock as claimed in claim 7 said legs joined at one end by an arcuate member.

9. A lock as claimed in claim 8, said arcuate member being resilient.

10. A lock as claimed in claim 1, said rotatable member of polygonal cross-section.

11. A lock as claimed in claim 10, said rotatable member of square cross-section.

12. An inside lock for a latch of a camper shell and similar structures, said latch including a housing and an elongate rotatable member extending from said housing, comprising a lock member for fixedly positioning around said rotatable member, said lock member comprising a further housing, and a bore in said further housing, said rotatable member freely rotatable in said bore; at least one hole through said further housing, normal to the axis of the bore, said hole crossing said bore at its periphery; and a removable member for insertion in said hole, said removable member including a part for abutment against a surface on said rotatable member when inserted in said hole, to prevent rotation of said rotatable member.

13. A lock as claimed in claim 12, said rotatable member having at least one said surface.

14. A lock as claimed in claim 12, said rotatable member having a polygonal cross-section.

15. A lock as claimed in claim 12, said removable member comprising a member having two substantially parallel legs, one of said legs for insertion in said hole.

16. A lock as claimed in claim 15, said legs joined at one end by a resilient member, for resilient moving apart of said legs.

17. A lock as claimed in claim 16, the other of said legs having a bent formation, extending away from said one leg, whereby said one leg is inserted in said hole, said other leg is in resilient engagement at said bent formation with an outside surface of said housing of said lock member.

18. A lock as claimed in claim 12, including two holes through said housing of said lock member, said holes spaced apart and substantially parallel, said removable member having two substantially parallel legs, a leg for insertion in each of said holes, said legs abutting opposed surfaces on said rotatable member.

19. A lock as claimed in claim 18, said legs joined at one end by a resilient member.

* * * * *